United States Patent [19]

Suzuki

[11] Patent Number: 4,636,087

[45] Date of Patent: Jan. 13, 1987

[54] GEAR TRAIN MECHANISM STOP DEVICE OF TIMEPIECE

[75] Inventor: Toshiyuki Suzuki, Fussa, Japan

[73] Assignee: Casio Computer Co., Ltd., Tokyo, Japan

[21] Appl. No.: 822,018

[22] Filed: Jan. 24, 1986

[30] Foreign Application Priority Data

Jan. 29, 1985 [JP] Japan ..... 60-9920[U]

[51] Int. Cl.[4] ..... G04B 17/12; G04B 27/02

[52] U.S. Cl. ..... 368/185; 368/190

[58] Field of Search ..... 368/76, 80, 185, 190–195, 368/319–321

[56] References Cited

U.S. PATENT DOCUMENTS

| | | | |
|---|---|---|---|
| 2,212,535 | 8/1940 | Ayres | 368/195 |
| 3,691,753 | 9/1972 | Kurita | 368/156 |
| 3,817,024 | 6/1974 | Noguchi | 368/185 |
| 4,396,294 | 8/1983 | Yoshida | 368/191 |

*Primary Examiner*—Vit W. Miska

*Attorney, Agent, or Firm*—Frishauf, Holtz, Goodman & Woodward

[57] ABSTRACT

A gear train mechanism stop device is used in a timepiece having clock signal producing IC, a stepping motor for generating a given rotational movement in response to a clock signal produced from the IC, at least hour and minute hands, and a gear train mechanism for transmitting the rotational movement from the motor to hands so as to make the hands move in a given movement, which is selectively engaged with a specified gear in the gear train mechanism so as to stop rotation of the specified gear. The device comprises an engaging member movable between an engaged position at which the member is engaged with the specified gear in the gear train mechanism in the axial direction of the specified gear so as to stop rotation of the specified gear, and a disengaged position at which the member is disengaged from the specified gear and allows the specified gear to rotate so as to allow rotational movement transmission from the motor to the hands, and an operation member for selectively moving the engaging member between the engaged and disengaged positions, wherein the specified gear is made of a synthetic resin.

20 Claims, 18 Drawing Figures

GEAR TRAIN MECHANISM STOP DEVICE OF TIMEPIECE

BACKGROUND OF THE INVENTION

The present invention relates to a gear train mechanism stop device which is used in a timepiece comprising clock signal producing means; a rotational movement source for generating a given rotational movement in response to a clock signal generated from the clock signal producing means; time indication hand means having at least hour and minute hands; and a gear train mechanism for transmitting the rotational movement from the rotational movement source to the time indication hand means so as to make the time indication hand means move in a given movement, and which is selectively engaged with a specified gear in the gear train mechanism so as to stop rotation of the specified gear.

In a gear train mechanism stop device of a timepiece such as an analog wristwatch of a battery-powered type, a crown normally serves as an operation member of the device. When the crown is moved from a pushed-in position to a drawn-out position, an electronic circuit constituting a clock signal producing means is reset so as to be inhibitated a producing of a clock signal, and a specified gear in a gear train mechanism is stopped, thereby stopping rotational movement transmission from a rotational movement source to a time indication hand means. When the crown at the drawn-out position is rotated clockwise or counterclockwise, hour and minute hands of the time indication hand means can be moved in order to correct time.

In the conventional timepiece gear train mechanism stop device, a rockable member is coupled to an internally extending portion of the crown so as to be rocked between first and second positions upon movement of the crown between the pushed-in and drawn-out positions. The rockable member is coupled to a rotational type engaging member. When the rockable member rotates from the first position to the second position, the engaging member rotates to its engaged position at which the distal end of the engaging member is engaged with the tooth of the specified gear in the gear train mechanism from the radial direction of the corresponding gear. When the rockable member rotates from the second position to the first position, the engaging member rotates to its disengaged position at which the distal end of the engaging member is separated from the tooth or the specified gear in the gear train mechanism in the radial direction of the corresponding gear.

In the conventional timepiece gear train mechanism stop device, not only a pivotal central shaft of the rotational type engaging member, but also a relatively large space in the horizontal direction is necessary in order to rotate the engaging member. Therefore, the number of parts in the timepiece and manufacturing costs are increased, and assembly becomes complex. In addition, it is difficult to reduce the whole size of the timepiece. Furthermore, since the engaging member is engaged with the tooth of the specified gear in the gear train mechanism from the radial direction thereof, a relatively large force is applied to a bearing for the specified gear engaged with the engaging member from the radial direction of the specified gear, and the bearing thus wears down easily. In addition, the tooth of the specified gear engaged with the engaging member also wears down easily.

Another timepiece gear train mechanism stop mechanism has been shown in U.S. Pat. No. 3,691,753. In this patent, a cam is concentrically fixed to one gear in a gear train mechanism. When a rotational type engaging member is engaged with the cam from the radial direction of the gear, rotation of the gear is stopped.

The gear train mechanism stop device shown in U.S. Pat. No. 3,691,753 can prevent the tooth of the gear in the gear train mechanism from being worn down, since the rotational type engaging member is not engaged with the tooth of the gear from the radial direction of the gear. However, the other problems of the conventional device cannot be resolved.

SUMMARY OF THE INVENTION

The present invention has been made in consideration of the above situation, and has as its object to provide a gear train mechanism stop device which allows a decrease in the number in parts of a timepiece, resulting in lower manufacturing costs and easier assembly. The gear train mechanism stop device must allow easy reduction in whole size of the timepiece, and prevent the bearings for the gear from being worn out. Further the device must prevent the tooth of a gear engaged with an engaging member from being worn down.

Embodiments and modifications will be described hereinafter with reference to the accompanying drawings.

DETAILED DESCRIPTION OF THE PREFERRED EMBODIMENTS

Figure 1:
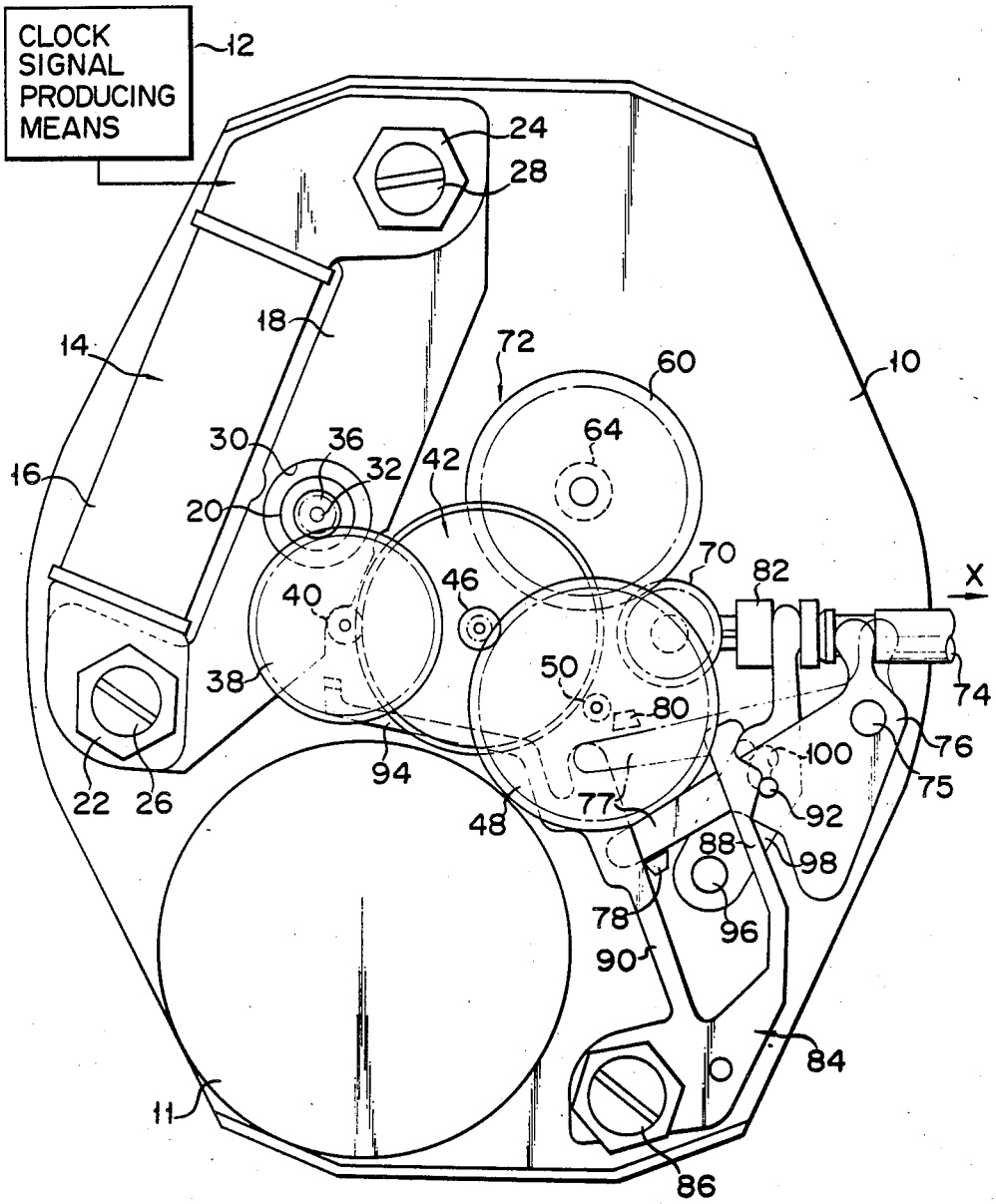
FIG. 1 is a plan view showing a back surface of a base plate of a battery-powered type analog wristwatch comprising a gear train stop device according to a first embodiment of the present invention.

FIG. 1 shows base plate 10 arranged in a case (not shown) of a battery-powered type analog wristwatch comprising a gear train mechanism stop device according to a first embodiment of the present invention.

In this embodiment, base plate 10 is made of a synthetic resin. Battery 11, clock signal generating IC 12 as a clock signal producing means, and stepping motor 14 as a rotational movement source for generating a specified rotational movement in response to the clock signal from IC 12 are arranged on the back surface of base plate 10. In this embodiment, although IC 12 is fixed to the back surface of base plate 10, it is indicated by a block outside base plate 10 in order to make FIG. 1 simple.

Figure 2:
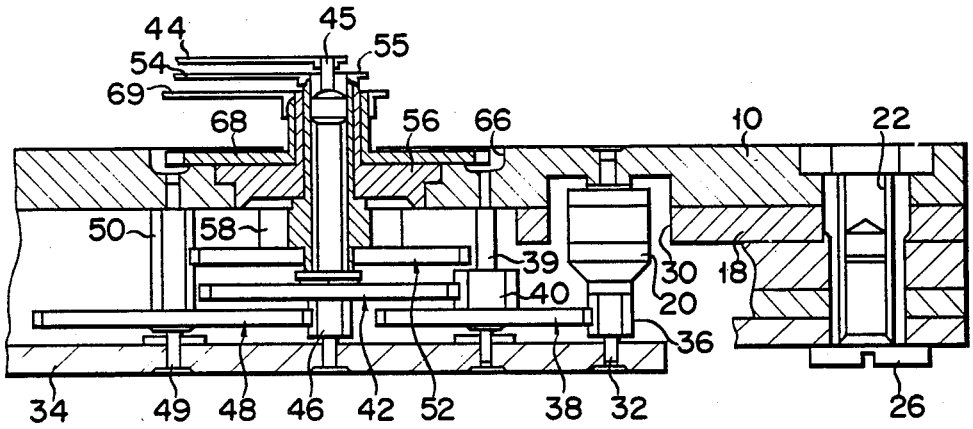
FIGS. 2 and 3 are different longitudinally cross-sectional views of the gear train mechanism of the wristwatch shown in FIG. 1.

As is known to those skilled in the art, stepping motor 14 comprises coil 16, stator 18, and rotor 20. In this embodiment, a unit of coil 16 and stator 18 is fixed to the back surface of base plate 10 through insulators 22 and 24 by screws 26 and 28. Rotor 20 is inserted in through hole 30 formed in stator 18. As shown in FIG. 2, one end of output shaft 32 of rotor 20 is rotatably supported by the back surface of base plate 10, and the other end is rotatably supported by bearing plate 34 fixed to the back surface of plate 10 to separate therefrom at a given distance. Synthetic resin gear 36 is concentrically fixed to the other end of shaft 32 at a position near plate 34. In this embodiment, rotor 20 (excluding its magnets) and plate 34 are made of a synthetic resin.

Gear 36 of rotor 20 meshes with intermediate gear 38 made of a synthetic resin. Gear 38 is rotatably supported at its both ends by plates 10 and 34, respectively.

Figure 3:
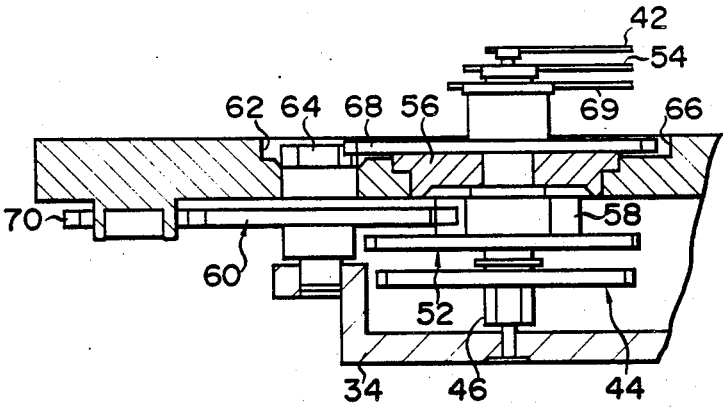

Intermediate pinion 40 made of a synthetic resin is concentrically and integrally formed with gear 38, and meshes with second-hand gear 42 made of a synthetic resin. Gear 42 is concentrically and integrally formed with central shaft 45, one end of which penetrates an opening formed in base plate 10 and is fixed to second hand 44, and the other end of which is rotatably supported by plate 34. Second-hand pinion 46 made of a synthetic resin is concentrically and integrally formed with gear 42 and meshes with first idler gear 48 made of a synthetic resin. Gear 48 is concentrically and integrally formed with central shaft 49 both end of which are rotatably supported by plates 10 and 34, respectively. First idler pinion 50 made of a synthetic resin is concentrically and integrally formed with gear 48 and meshes with metal minute-hand gear 52. Gear 52 is mounted on the bearing plate side end of cylindrical central shaft 55 so as to slip when a rotational force higher than a predetermined value is applied. The other end of central shaft 55 penetrates the opening formed in base plate 10 and is fixed to minute hand 54. Cylindrical central shaft 55 of gear 52 is concentrical with central shaft 45 of gear 42, and is rotatably supported by another bearing plate 56 provided in the opening of base plate 10. Central shaft 45 of gear 42 is rotatably supported by an inner circumferential surface of cylindrical central shaft 55 of gear 52. Minute-hand pinion 58 is concentrically and integrally formed with shaft 55, and as shown in FIG. 3, meshes with second idler gear 60 made of a synthetic resin. Both ends of the central shaft of gear 60 are rotatably supported by plates 10 and 34, respectively. Recess 62 is formed on the front surface of base plate 10 where corresponds to base plate side end of the central shaft of gear 60, as shown in FIG. 3. Second idler pinion 64 concentrically and integrally formed with base plate side end of the central shaft of gear 60 is arranged in recess 62.

Circular recess 66 is also formed on the front surface of base plate 10 so as to be concentrical with central shaft 45 of second hand gear 42 and cylindrical central shaft 55 of minute hand gear 52. Hour-hand gear 68 made of a synthetic resin is arranged in recess 66. Gear 68, as shown in FIG. 3, meshes with second idler pinion 64, and is rotatably and concentrically supported by a cylindrical projection formed on the surface of plate 56, the cylindrical projection of plate 56 being concentrical with central shaft 55 of gear 52 and slidably contacted the outer circumferential surface of shaft 55. Gear 68 also has a cylindrical projection which is concentrical with the cylindrical projection of plate 56 and slidably contacted the outer circumferential surface of the cylindrical projection of plate 56. Hour hand 69 is fixed to the distal end of the cylindrical projection of gear 68.

Gear 60, as shown in FIG. 3, meshes with third idler gear 70 which is rotatably mounted on the back surface of base plate 10.

In the above embodiment of the present invention, gear 36 of rotor 20, intermediate gear 38, intermediate pinion gear 40, second-hand gear 42, second-hand pinion 46, first idler gear 48, first idler pinion 50, minute-hand gear 52, minute-hand pinion 52, second idler gear 60, second idler pinion 64, and hour-hand gear 68 constitute gear train mechanism 72 for transmitting rotational movement from stepping motor 14 to second hand 44, minute hand 54, and hour hand 69.

As shown in FIG. 1, internally extending portion 74 of a crown intersects the back surface of base plate 10, which is provided in a case (not shown) to be movable along the back surface of base plate 10 in a direction substantially perpendicular to the central shafts of the various gears in gear train mechanism 72.

Rockable member 76 is attached on fixing pin 75 fixed to the back surface of base plate 10 to be pivotal in a direction parallel thereto. One end of rockable member 76 is connected to internally extending portion 74 of the crown so as to be rockable between first and second positions by movement of portion 74 of the crown between the pushed-in and the drawn-out position. In FIG. 1, portion 74 of the crown located at the pushed-in position and member 76 located at the first position are illustrated by solid lines, and portion 74 of the crown located at the drawn-out position and member 76 located at the second position are illustrated by one-dot chain lines. Arm-like other end 77 of member 76 selectively abuts against first and second stops 78 and 80 fixed to the back surface of base plate 10 when member 76 is located at the first or second position, thus defining a rocking distance of member 76 between the first and second positions and a moving distance of portion 74 between the pushed-in and drawn-out positions.

A spline is formed on a region near around the distal end of portion 74, and time indication hand means correction gear 82 of a synthetic resin is mounted on the splined region. Gear 82 is movable on the spline in the axial direction of portion 74, and is rotated in the circumferential direction thereof together with portion 74. Gear 82 is movable in the above axial direction between a time indication hand means corrective position at which gear 82 meshes with gear 70 and a time indication hand means incorrective position at which it is separated from gear 70. In FIG. 1, gear 82 is located at the time indication hand means incorrective position.

Substantially U-shaped thin metal plate 84 is fixed onto the back surface of base plate 10 by screw 86. End 77 of member 76 is located between branched extending portions 88 and 90 of plate 84 and the back surface of base plate 10. One extending portion 88 of plate 84 acts as a click spring having two recesses for abutting against fixing pin 92 fixed to member 76. Spring 88 can hold member 76 at the first or second position and therefor portion 74 can be held at the pushed-in or drawn-out position.

Figure 4:
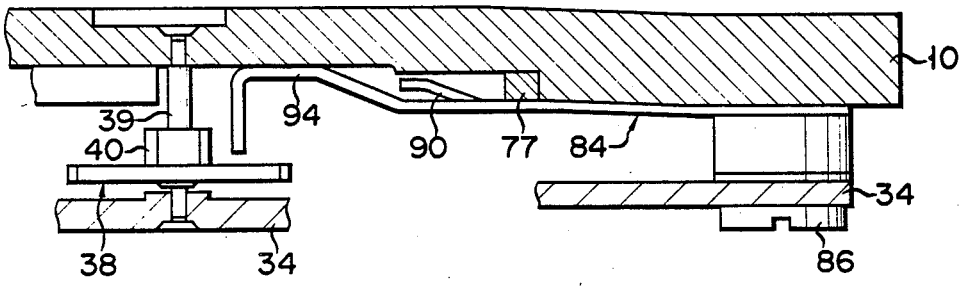
FIG. 4 is a longitudinally cross-sectional view showing a disengaged state of an engaging arm of the device shown in FIG. 1.

As shown in FIG. 4, another extending portion 90 of plate 84, which crosses the distal end portion of end 77 of member 76, gradually inclines, from a position corresponding to the distal end portion of end 77 when member 76 is at the first position (when the crown is at the pushed-in position) to a position corresponding to the distal end portion of end 77 when member 76 is at the second position (when the crown is at the drawn-out position), toward the back surface of base plate 10. Thus, inclined region of portion 90 crosses the moving path of the distal end portion of end 77 when member 76 rotates from the first position to the second position.

Figure 5:
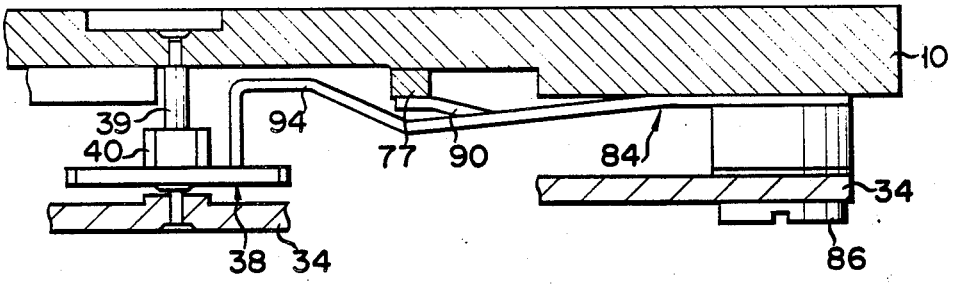
FIG. 5 is a longitudinally cross-sectional view showing an engaged state of the engaging arm shown in FIG. 4.

Engaging arm 94 extending to the top surface of gear 38 along the back surface of base plate 10 is formed in portion 90 of plate 84. Arm 94 is separated from the top surface of gear 38 when member 76 is at the first position (when the crown is at the pushed-in position), as shown in FIG. 4. When member 76 rotates from the first position indicated by the solid line in FIG. 1 to the second position indicated by the one-dot chain line (when the crown is moved from the pushed-in position indicated by the solid line in FIG. 1 to the drawn-out position indicated by the one-dot chain line), extending portion 90 of plate 84 is elastically deformed in a direction away from the back surface of base plate 10. As a result, as shown in FIG. 5, arm 94 is moved in the axial direction to engage with the top surface of gear 38 so as to stop its rotation. In this embodiment, arm 94 is engaged before member 76 reaches the second position (i.e., before the crown reaches the drawn-out position).

Swingable lever 98 is arranged on the back surface of plate 10 so as to be rotatably connected at its one end to fixing pin 96 fixed on the back surface of base plate 10. Lever 98 is swingably moved parallel to the back surface of plate 10 around pin 96. The other end of lever 98 extends between the back surface of plate 10 and member 76, and is coupled to gear 82.

Pin 92 of member 76 also extends in a direction approaching the back surface of base plate 10, and the base plate side end thereof is inserted into guide hole 100 formed in lever 98. Hole 100 causes lever 98 to rotate so that gear 82 is moved from the time indication hand means incorrective position (FIG. 1) to the time indication hand means corrective position, when member 76 moves from the first to second position (i.e., when the crown moves from the pushed-in position to the drawn-out position). Furthermore, hole 100 causes lever 98 to rotate, so that gear 82 is moved from the time indication hand means corrective position to the time indication hand means incorrective position (FIG. 1), when member 76 moves from the second to first position (i.e., when the crown moves from the drawn-out position to the pushed-in position).

In the first embodiment with the above arrangement, when the crown is moved in a direction indicated by arrow X from the pushed-in position indicated by the solid line in FIG. 1 to the drawn-out position indicated by the one-dot chain line, member 76 is moved from the first position indicated by the solid line in FIG. 1 to the second position indicated by the one-dot chain line. Before member 76 reaches the second position, engaging arm 94 of extending portion 90 of plate 84 is moved in the axial direction to engage with gear 38 of mechanism 72 so as to stop its rotation. When member 76 has reached the second position, gear 82 is located at the time indication hand means corrective position at which it meshes with gear 70.

When the crown is rotated clockwise or counterclockwise in this state, gears 58 and 68 can be rotated clockwise or counterclockwise through gears 82, 70, and 60, and minute and hour hands 54 and 69 can thus be moved in order to correct the time.

Next, when the crown is moved in the direction opposite to that indicated by arrow X from the drawn-out position indicated by the one-dot chain line in FIG. 1 to the pushed-in position indicated by the solid line, first of all, gear 82 is moved to the time indication hand means incorrective position indicated by the solid line in FIG. 1 so as to be disengaged from gear 70. Then, arm 94 of portion 90 of plate 84 is moved in the axial direction from the engaged position shown in FIG. 5 to the disengaged position shown in FIG. 4. Thus, a rotational force from stepping motor 14 is transmitted through gears 42, 52, and 68, thus moving hands 44, 54, and 69.

After gear 82 is moved to the time indication hand means incorrective position at which it is disengaged from gear 70, arm 94 can be moved to the disengaged position so as to move hands 44, 54, and 69. As a result, even if the crown is erroneously rotated clockwise or counterclockwise during movement of the crown from the drawn-out position to the pushed-in position, the positions of hands 54 and 69 which have already been corrected will not be changed.

A second embodiment of the present invention will now be described with reference to FIGS. 6 to 11.

The same reference numerals in this embodiment denote the same parts as in the first embodiment shown in FIGS. 1 to 5, and a detailed description thereof will be omitted.

Figure 7:
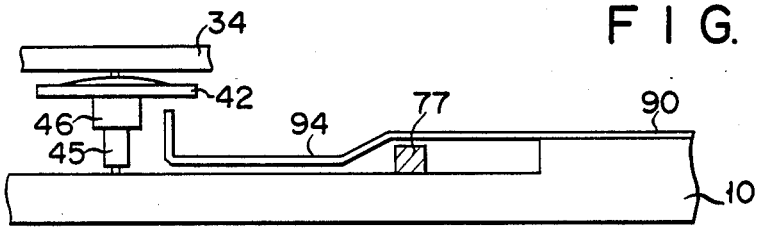
FIG. 7 is a longitudinally cross-sectional view schematically showing a disengaged state of an engaging arm of the device of the second embodiment.

The difference between the first and second embodiments is that an extending end of engaging arm 94 of extending portion 90 of thin metal plate 84 extends not to the top surface of intermediate gear 38 but to a position opposite the bottom surface of second-hand gear 42, as shown in FIG. 7.

In this embodiment, fixing pin 75 is fixed to rockable member 76, and the both ends of pin 75 are rotatably supported by a blind hole formed in base plate 10 and hole 104 formed in third extending portion 102 of thin metal plate 84, respectively.

The operation of the second embodiment is the same as that of the first embodiment.

Figure 6:
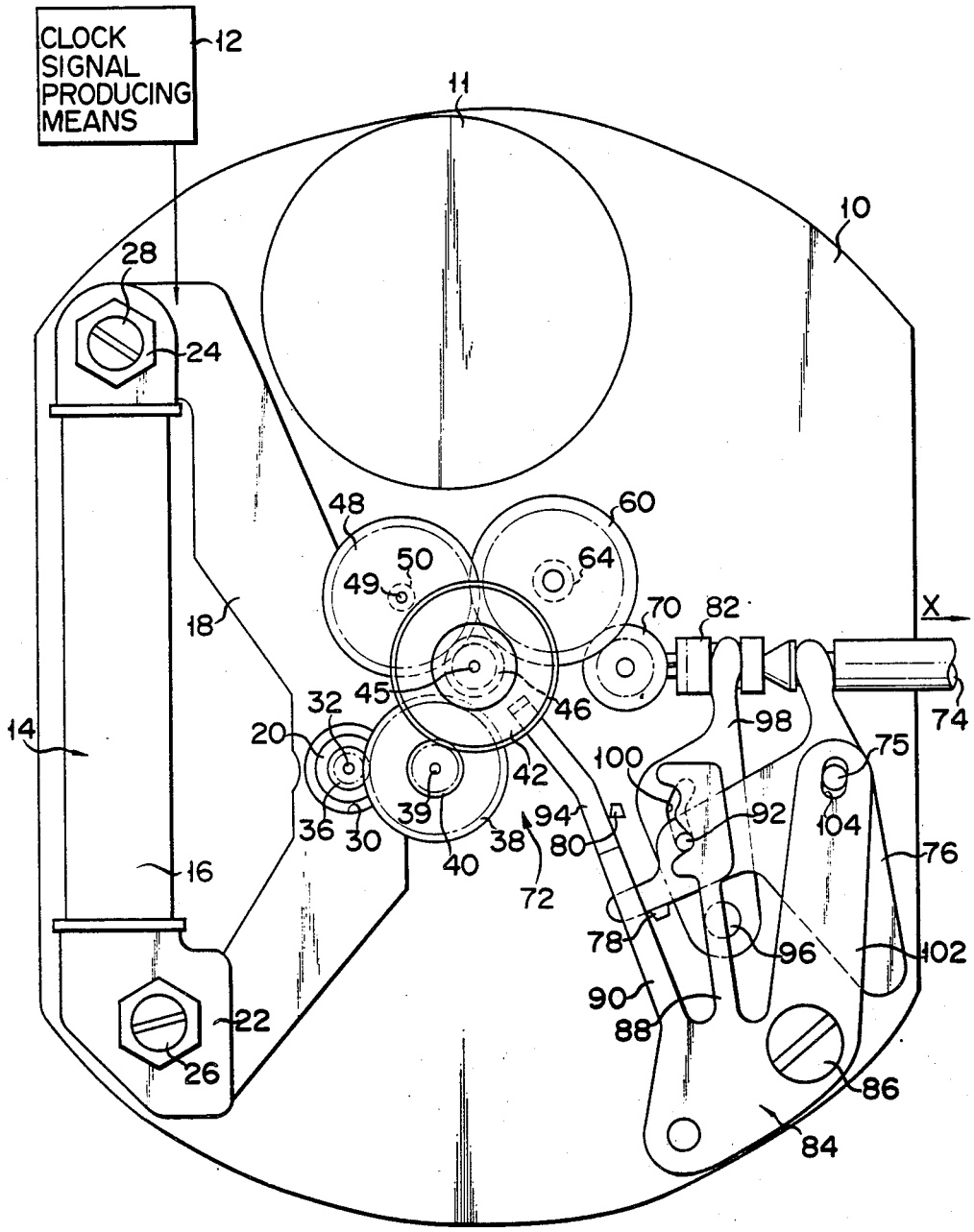
FIG. 6 is a plan view showing a back surface of a base plate of a battery-powered type analog wristwatch comprising a gear train stop device according to a second embodiment of the present invention, wherein a crown is located at a pushed-in position.

When the crown is moved in a direction indicated by arrow X from the pushed-in position shown in FIG. 6 to the drawn-out position, rockable member 76 rotates clockwise about fixing pin 75 from the first position shown in FIG. 6.

Figure 8:
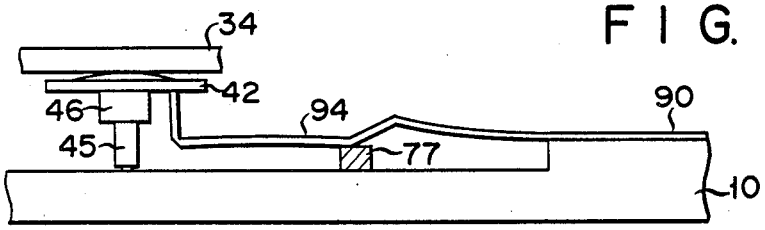
FIG. 8 is a longitudinally cross-sectional view schematically showing a state wherein the engaging arm of the second embodiment is located at the engaged position during movement of a crown from a pushed-in to a drawn-out position.

During the movement, arm-like end 77 of member 76 abuts against a bent region of extending portion 90 of plate 84, which is bent toward the base plate, as shown in FIG. 8. Thus, portion 90 is elastically deformed, and the extending end of arm 94 of portion 90 is engaged with the bottom surface of second-hand gear 42 so as to stop its rotation. At the same time, fixing pin 92 of member 76 is moved within guide hole 100 of swingable lever 98, and leaves lever 98 at the first position shown in FIG. 6.

Figure 9:
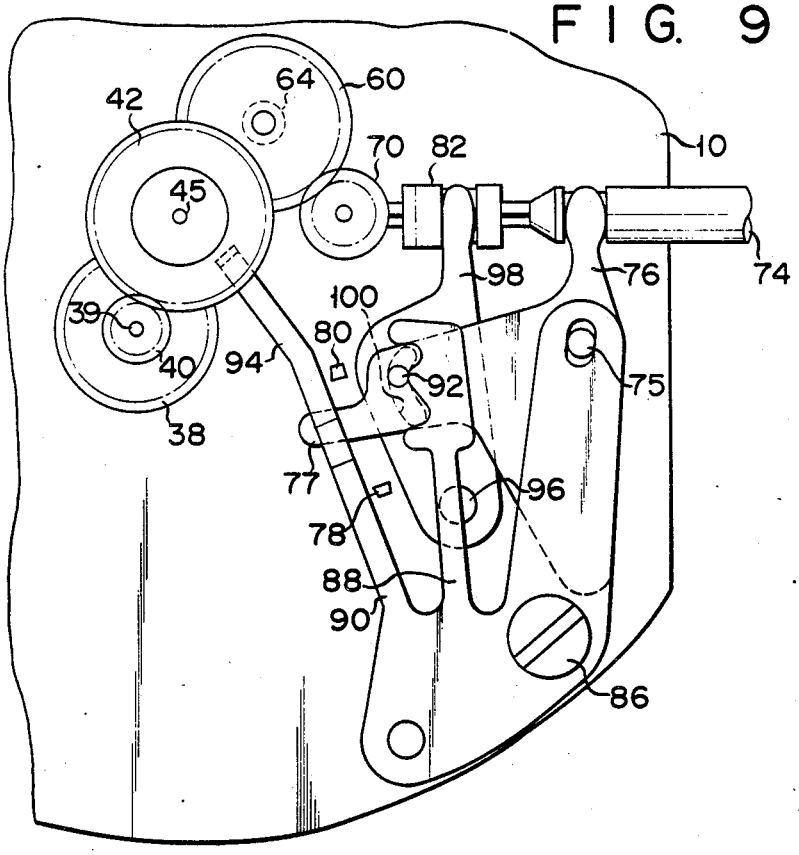
FIG. 9 is a plan view simply showing a main part of the back surface of the base plate of the second embodiment in the state of FIG. 8.
Figure 10:
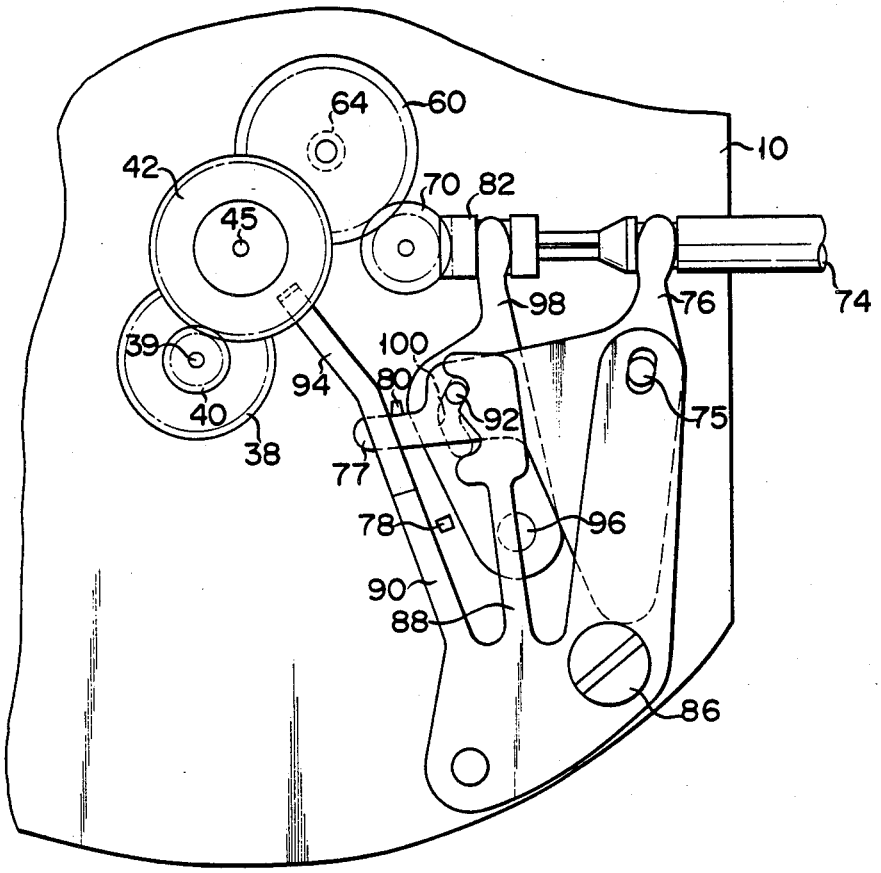
FIG. 10 is a plan view just as FIG. 9 showing a main part of the back surface of the base plate of the second embodiment when the crown is drawn out.
Figure 11:
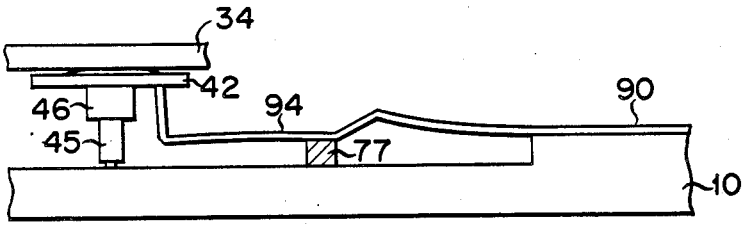
FIG. 11 is a longitudinally cross-sectional view schematically showing as in FIGS. 7 and 8 the engaging arm in the state shown in FIG. 10.

Even after the extending end of arm 94 is engaged with the bottom surface of gear 42, when the crown is moved further in the direction indicated by arrow X, member 76 rotates until end 77 abuts against second stop 80, as shown in FIG. 10. This further movement of member 76 causes lever 98 to rotate counterclockwise from a position shown in FIG. 9 (same as the first position shown in FIG. 6). When this rotational movement of member 76 stops (when member 76 has reached the second position), time indication hand means correction gear 82 is located at the time indication hand means corrective position, at which it meshes with third idler gear 70 as shown in FIG. 10. At the same time, as shown in FIG. 11, arm 94 is left engaged with gear 42.

If the crown is rotated clockwise or counterclockwise in this state, minute hand 54 and hour hand 69 can be moved to correct the time as described above.

When the crown is moved from the drawn-out position to the pushed-in position indicated by the solid line in FIG. 6 in the direction opposite to that indicated by arrow X, member 76 rotates from the second position at which end 77 abuts against second stop 80 as shown in FIG. 10 to the position at which end 77 abuts against first stop 78, as shown in FIG. 6. During this rotational movement, at first, lever 98 rotates from the second position shown in FIG. 10 to the first position shown in FIG. 9, so that gear 82 is moved from the time indication hand means corrective position at which it is engaged with gear 70 to the time indication hand means incorrective position at which it is disengaged from gear 70, as shown in FIG. 9. Then, arm 94 of portion 90 of plate 84 is elastically deformed from the engaged position shown in FIGS. 11 and 8 to the disengaged position shown in FIG. 7. After gear 82 is moved to the time indication hand means incorrective position at which it is disengaged from gear 70, arm 94 can be moved to the disengaged position so as to move hands 44, 54, and 69. As a result, even if the crown is erroneously rotated clockwise or counterclockwise during movement of the crown from the drawn-out position to the pushed-in position, the positions of hands 54 and 69 which have already been corrected will not be changed. When arm 94 is moved to the disengaged position shown in FIG. 7, the second, minute, and hour hands (although not shown in the second embodiment) can be made their given movement by the rotational movement from stepping motor 14 as described above.

The above embodiments have been examplified for explaining the present invention. Various modifications may be made within the spirit and scope of the invention.

For example, the specified gear in gear train mechanism 72 meshed with engaging arm 94 can be tapered, as shown in FIG. 7, from its rotational center toward the teeth. In this way, the gear can be prevented from being deformed in its axial direction due to engagement with engaging arm 94 in the axial direction. This modification is particularly advantageous when the gear is made of a synthetic resin. In addition, an increase in inertial force can be suppressed.

Figure 12:
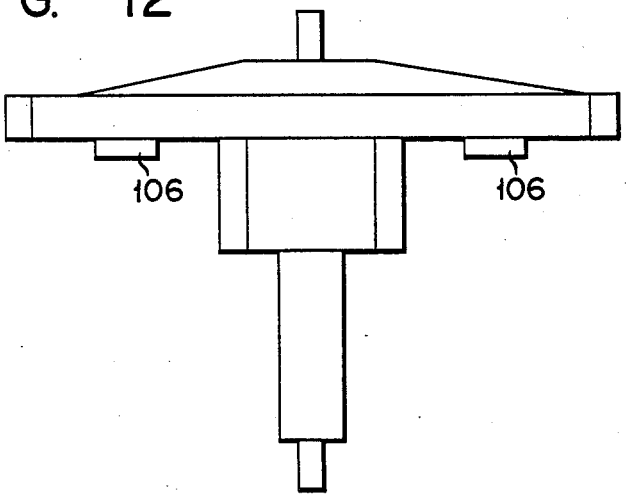
FIG. 12 is a side view showing a modification of a specified gear in the gear train mechanism engaged with the engaging arm.
Figure 13:
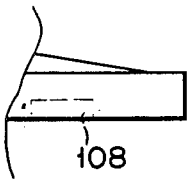
FIGS. 13 to 18 are views showing modifications of radial sectional shapes of a plurality of projections and recesses formed in an engaging region of a top surface of the specified gear engaged with the engaging arm so as to be concentrical with a rotational center of the gear.
Figure 14:
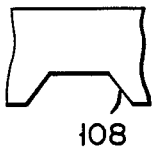
Figure 15:
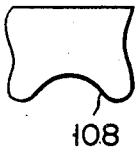
Figure 16:
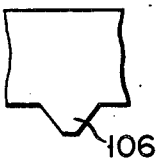
Figure 17:
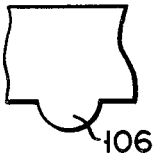
Figure 18:
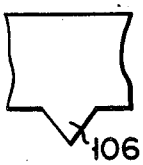

In the specified gear, as shown in FIG. 12, a plurality of projections 106 can be formed on the engaged region of the surface of the gear with which arm 94 engages, so as to be arranged concentrically with the rotational center of the gear. Alternatively, as shown in FIG. 13, a plurality of recesses 108 can be formed instead of projections 106. Each recess 108 can have a rectangular or square-shaped cross section in its radial direction, as shown in FIG. 13. Alternatively, each recess 108 can have an isosceles-trapezoidal or partially circular cross section, as shown in FIGS. 14 and 15. Each projection 106 can also have a rectangular or square-shaped cross section in its radial direction, as shown in FIG. 12, or an isosceles-trapezoidal, partially circular, or triangular cross section, as shown in FIGS. 16, 17, and 18.

Even if engaging arm 94 weakly abuts against the specified gear in mechanism 72 in the axial direction, projections 106 and recesses 108 satisfactorily stop the corresponding gear. Since a large force need not be applied to the gear, the gear can be protected from deformation or damage.

In the present invention, the specified gear in mechanism 72 with which engaging arm 94 is engaged in the axial direction can be minute-hand gear 52.

What is claimed is:

1. A gear train mechanism stop device which is used in a timepiece having clock signal producing means; a rotational movement source for generating a given rotational movement in response to a clock signal produced from said clock signal producing means; time indication hand means having at least hour and minute hands; and a gear train mechanism for transmitting the rotational movement from said rotational movement source to said time indication hand means so as to make said time indication hand means move in a given movement, which is selectively engaged with a specified gear in said gear train mechanism so as to stop rotation of said specified gear, and which is characterized by comprising:

an engaging member movable between an engaged position at which said member is engaged with said specified gear in said gear train mechanism in the axial direction of said specified gear so as to stop rotation of said specified gear, and a disengaged position at which said member is disengaged from said specified gear in said gear train mechanism and allows said specified gear to rotate so as to allow rotational movement transmission from said rotational movement source to said time indication hand means; and an operation member for selectively moving said engaging member between the engaged and disengaged positions, wherein said specified gear is made of a synthetic resin.

2. A device according to claim 1, wherein said operation member is movable between first and second positions in a direction substantially perpendicular to the axial direction of said specified gear, and said engaging member is a thin metal plate which is moved to the engaged position by the movement of said operation member from the first position to the second position, and is moved to the disengaged position by the movement of said operation member from the second position to the first position.

3. A device according to claim 2, wherein said operation member is coupled to a rockable member so as to make said rockable member rotate to the first position by the movement of said operation member from the second position to the first position, and make said rockable member rotate to the second position by the movement of said operation member from the first position to the second position, and said thin metal plate is moved to the engaged position by the rotation of said rockable member from the first position to the second position, and is moved to the disengaged position by the rotation of said rockable member from the second position to the first position.

4. A device according to claim 3, wherein said rockable member has a fixing pin, and a click spring which abuts against said fixing pin so as to selectively hold said rockable member at the first or second position is formed in said thin metal plate.

5. A device according to claim 1, wherein at least one recess concentrical with the rotational center of said specified gear is formed in a surface of said specified gear located in the axial direction, which is engaged with said engaging member, and said engaging member is engaged with said at least one recess at the engaged position so as to stop the rotation of said specified gear.

6. A device according to claim 1, wherein said specified gear in said gear train mechanism is an intermediate gear which is interposed between an input gear, which first receives the rotational movement from said rotational movement source, and a plurality of time indication hand gears directly coupled to said time indication hand means, and which transmits the rotational movement from said rotational movement source to said time indication hand gears through said input gear.

7. A device according to claim 1, wherein said time indication hand means has a second hand, and said specified gear in said gear train mechanism is a time indication hand gear directly coupled to said second hand in said time indication hand means.

8. A device according to claim 1, wherein said specified gear in said gear train mechanism is tapered from its rotation center toward teeth thereof so as to decrease its thickness.

9. A gear train mechanism stop device which is used in a timepiece having clock signal producing means; a rotational movement source for generating a given rotational movement in response to a clock signal produced from said clock signal producing means; time indication hand means having at least hour and minute hands; and a gear train mechanism for transmitting the rotational movement from said rotational movement source to said time indication hand means so as to make said time indication hand means move in a given movement, which is selectively engaged with a specified gear in said gear train mechanism so as to stop rotation of said specified gear, and which is characterized by comprising:

an engaging member movable between an engaged position at which said member is engaged with said specified gear in said gear train mechanism in the axial direction of said specified gear so as to stop rotation of said specified gear, and a disengaged position at which said member is disengaged from said specified gear in said gear train mechanism and allows said specified gear to rotate so as to allow rotational movement transmission from said rotational movement source to said time indication hand means; and an operation member movable between first and second positions in a direction substantially perpendicular to the axial direction of said predetermined gear, and for causing said engaging member to move to the engaged position by the movement thereof from the first position to the second position and to move to the disengaged position by the movement thereof from the second position to the first position, wherein said operation member is coupled to time indication hand correction means for correcting said time indication hand means at the second position.

10. A device according to claim 9, wherein said specified gear in said gear train mechanism is made of a synthetic resin.

11. A device according to claim 9, wherein said operation member is coupled to a rockable member so as to make said rockable member rotate to a first position by the movement of said operation member from the second position to the first position, and make said rockable member rotate to a second position by the movement of said operation member from the first position to the second position, and said engaging member is moved to the engaged position by the rotation of said rockable member from the first position to the second position, and is moved to the disengaged position by the rotation of said rockable member from the second position to the first position.

12. A device according to claim 9, wherein at least one recess concentrical with the rotational center of said specified gear is formed in a surface of said specified gear located in the axial direction, which is engaged with said engaging member, and said engaging member is engaged with said at least one recess at the engaged position so as to stop the rotation of said specified gear.

13. A device according to claim 9, wherein said specified gear in said gear train mechanism is an intermediate gear which is interposed between an input gear, which first receives the rotational movement from said rotational movement source, and a plurality of time indication hand gears directly coupled to said time indication hand means, and which transmits the rotational movement from said rotational movement source to said time indication hand gears through said input gear.

14. A device according to claim 9, wherein said time indication hand means has a second hand, and said specified gear in said gear train mechanism is a time indication hand gear directly coupled to said second hand in said time indication hand means.

15. A gear train mechanism stop device which is used in a timepiece having clock signal producing means; a rotational movement source for generating a given rotational movement in response to a clock signal produced from said clock signal producing means; time indication hand means having at least hour and minute hands; and a gear train mechanism for transmitting the rotational movement from said rotational movement source to said time indication hand means so as to make said time indication hand move in a given movement, which is selectively engaged with a specified gear in said gear train mechanism and so as to stop rotation of said specified gear, and which is characterized by comprising:

an engaging member movable between an engaged position at which said member is engaged with said specified gear in said gear train mechanism in the axial direction of said specified gear so as to stop rotation of said specified gear, and a disengaged position at which said member is disengaged from said specified gear in said gear train mechanism and allows said specified gear to rotate so as to allow rotational movement transmission from said rotational movement source to said time indication hand means;

a time indication hand correction gear movable between a time indication hand corrective position at which said time indication hand correction gear meshes with any one of gears in said gear train mechanism so as to correct said time indication hand means, and a time indication hand incorrective position at which said time indication hand correction gear is disengaged from the one gear in said gear train mechanism;

an operation member which is movable between first and second positions in a direction substantially perpendicular to the axial direction of said specified gear, which causes said engaging member to move to the engaged position and causes said time indication hand correction gear to move to the time indication hand corrective position by the movement thereof from the first position to the second position, and which causes said engaging member to move to the disengaged position and causes said time indication hand correction gear to move to the time indication hand incorrective position by the movement thereof from the second position to the first position; and time-delay setting means which, at first, disengages said time indication hand correction gear from the one gear in said gear train mechanism, and then causes said engaging member to move from the engaged position to the disengaged position, during the movement of said operation member from the second position to the first position.

16. A device according to claim 15, wherein said operation member is coupled to a rockable member so as to make said rockable member rotate to a first position by the movement of said operation member from the second position to the first position, and make said rockable member rotate to a second position by the movement of said operation member from the first position to the second position, and said engaging member is moved to the engaged position by the rotation of said rockable member from the first position to the second position, and is moved to the disengaged position by the rotation of said rockable member from the second position to the first position.

17. A device according to claim 15, wherein said operation member is coupled to a rockable member so as to make said rockable member rotate to a first position by the movement thereof from the second position to the first position, and make said rockable member rotate to a second position by the movement thereof from the first position to the second position, and said time-delay setting means comprises: a fixing pin fixed to said rockable member; a gear moving member which is coupled to said time indication hand correction gear so as to be moved to a first position by the movement of said time indication hand correction gear from the time indication hand corrective position to the time indication hand incorrective position, and to be moved to a second position by the movement of said time indication hand correction gear from the time indication hand incorrective position to the time indication hand corrective position; and a guide hole formed in said gear moving member to allow insertion of said fixing pin of said rockable member therethrough.

18. A device according to claim 15, wherein said operation member is coupled to a rockable member so as to make said rockable member rotate to a first position by the movement thereof from the second position to the first position, and make said rockable member rotate to a second position by the movement thereof from the first position to the second position, and said time-delay setting means comprises: a fixing pin fixed to said rockable member; a gear moving member which is coupled to said time indication hand correction gear so as to be moved to a first position by the movement of said time indication hand correction gear from the time indication hand corrective position to the time indication hand incorrective position, and to be moved to a second position by the movement of said time indication hand correction gear from the time indication hand incorrective position to the time indication hand corrective position; and a guide hole, formed in said gear moving member, into which said fixing pin of said rockable member is inserted, which causes said gear moving member to move from the first position to the second position so as to move said time indication hand correction gear to the time indication hand corrective position by the movement of said rockable member from the first position to the second position after said engaging member has been moved from the disengaged position to the engaged position, and causes said gear moving member to move from the second position to the first position so as to move said time indication hand correction gear to the time indication hand incorrective position by the movement of said rockable member from the second position to the first position before said engaging member starts moving from the engaged position to the disengaged position.

19. A device according to claim 15, wherein said specified gear in said gear train mechanism is made of a synthetic resin.

20. A device according to claim 15, wherein said specified gear in said gear train mechanism is an intermediate gear which is interposed between an input gear, which first receives the rotational movement from said rotational movement source, and a plurality of time indication hand gears directly coupled to said time indication hand means, and transmits the rotational movement from said rotational movement source to said time indication hand gears through said input gear.

* * * * *